United States Patent [19]

Luke

[11] 4,273,600

[45] Jun. 16, 1981

[54] BONDING FIBRILLATED POLYPROPYLENE SMOKE FILTER WITH ETHYLENE-VINYLACETATE EMULSION

[75] Inventor: John A. Luke, Romsey, England

[73] Assignee: Brown & Williamson Tobacco Corporation, Louisville, Ky.

[21] Appl. No.: 61,144

[22] Filed: Jul. 26, 1979

Related U.S. Application Data

[63] Continuation-in-part of Ser. No. 877,153, Feb. 13, 1978, abandoned, which is a continuation of Ser. No. 703,392, Jul. 8, 1976, abandoned.

[30] Foreign Application Priority Data

Jul. 11, 1975 [GB] United Kingdom ..... 29261/75

[51] Int. Cl.[3] ..... A24C 5/50

[52] U.S. Cl. ..... 156/180; 156/296; 493/50

[58] Field of Search ..... 156/180, 296, 305, 441, 156/732; 131/267, 268, 10.9; 428/375, 378, 294, 295; 93/1 C

[56] References Cited

U.S. PATENT DOCUMENTS

| | | | |
|---|---|---|---|
| 3,173,427 | 3/1965 | Tamblyn et al. | 131/269 |
| 3,359,148 | 12/1967 | Fukui | 156/180 |
| 3,390,039 | 6/1968 | Caughman et al. | 156/180 |
| 3,463,688 | 8/1969 | Harrington, Jr. et al. | 156/180 |

FOREIGN PATENT DOCUMENTS 46-276 1/1971 Japan .

*Primary Examiner*—Michael W. Ball

*Attorney, Agent, or Firm*—Charles G. Lamb; William J. Mason

[57] ABSTRACT

The invention relates to the treatment of fibre, particularly for making rods of bonded, fibrillated polyolefin fibre which can be used for example as or in tobacco smoke filters. The fibres may be crimped or straight and are bonded with a polymeric or copolymeric bonding agent which is applied to the fibres without the application of heat, the bonding agent being in the form of a cold setting emulsion, applied for example by means of a shear cone rotating at high speed or by brush means, the treated fibres then being formed to shape and allowed to cure in normal conditions and in the absence of heating.

2 Claims, 1 Drawing Figure

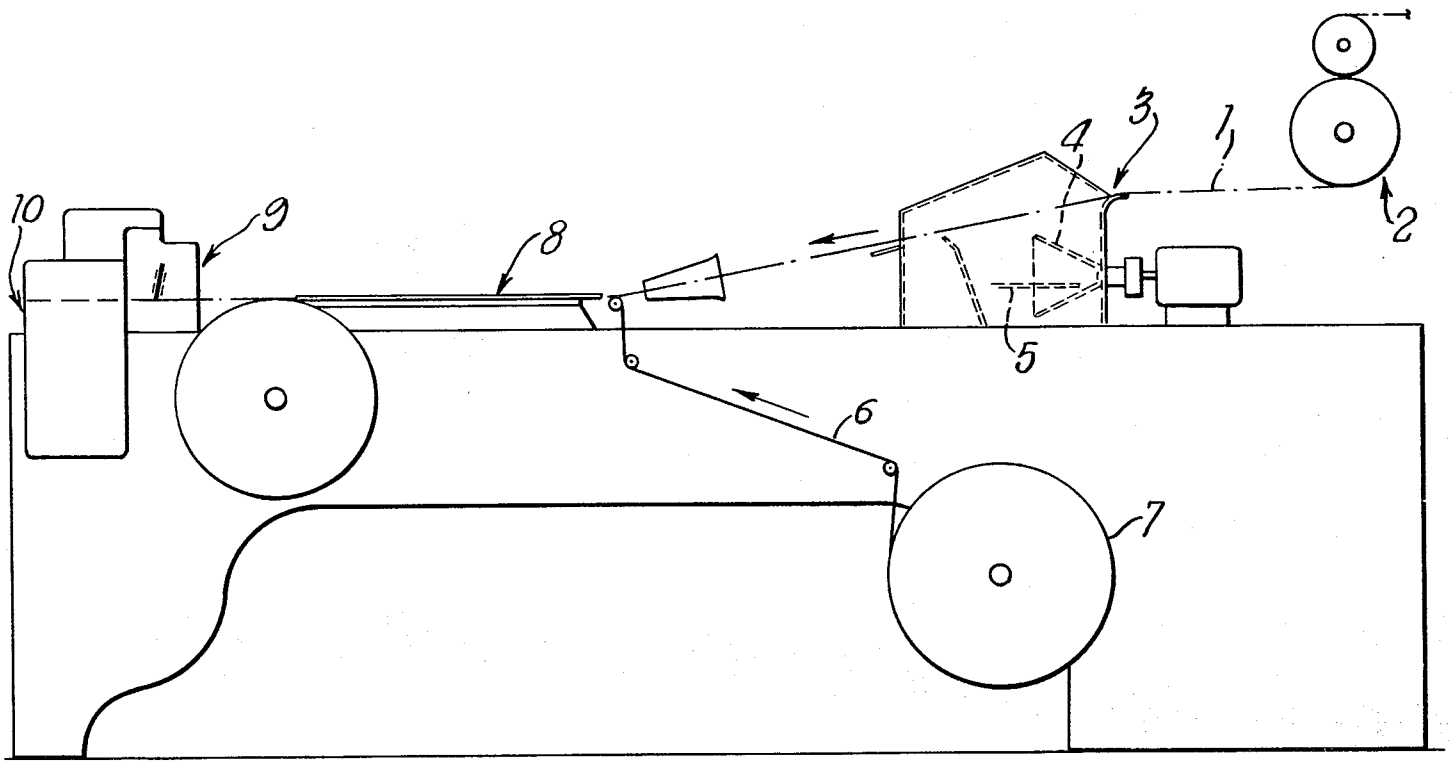
1
2
3
4
5
6
7
8
9
10

BONDING FIBRILLATED POLYPROPYLENE SMOKE FILTER WITH ETHYLENE-VINYLACETATE EMULSION

CROSS REFERENCE TO RELATED APPLICATIONS

This application is a continuation-in-part of copending application Ser. No. 877,153 filed Feb. 13, 1978, now abandoned, entitled "Treatment of Fibrillated Fibres" which is a continuation of application Ser. No. 703,392, filed July 8, 1976, entitled "Treatment of Fibrillated Fibres" and now abandoned. The later and abandoned application was a foreign filing of Great Britain, Ser. No. 29261/75, filed July 11, 1975.

BACKGROUND OF THE INVENTION

The invention concerns the treatment of fibres and is concerned with a method for making rods of bonded fibrillated polyolefin, preferably polypropylene, particularly for use as or in tobacco-smoke filters.

To improve the firmness of tobacco-smoke filter rod composed of a tow of crimped continuous or fibrillated filaments of polyolefin, it is known to use a polymeric bonding agent. The non-volatile liquid organic plasticizers which are effective bonding agents for crimping cellulose-acetate tow cannot be used for bonding polyolefins, as they do not soften polyolefin fibres. Polyolefin tow can be bonded by mixing with another polyolefin, particularly polyethylene, and heating the rod to effect fusion. The bonding agent, for example polyethylene, may be incorporated during the melt-spinning operation. Polyolefin tow may alternatively be bonded by using a spray of, for example, a polymerizable unsaturated organic ester such as vinylacetate, an acrylate ester or a vinyl ether. Generally the rod is heated to effect curing.

SUMMARY OF THE INVENTION

It is an object of the present invention to provide a method for producing a tobacco-smoke filter, composed of fibrillated polyolefin fibres, which has improved firmness without requiring the application of heat in a separate heat-curing stage and using low levels of bonding agent.

According to the invention, for making tobacco-smoke filter rod from fibrillated polyolefin fibres, particularly crimped polypropylene fibres, the fibres are spread and are treated with a cold-setting bonding or adhesive agent consisting substantially of an emulsion, applied to the fibres of a nonvolatile polymeric or copolymeric unsaturated organic ester, which emulsion has a viscosity in the range of 10 to 500 centipoise and a solids content in the range from 10 to 60%, preferably 30 to 60% and more preferably from 45 to 55%, by weight, whereafter the treated tow is brought to rod form. The viscosity of the emulsion is from 10 to 500 centipoise and preferably within the range from 10 to 200 centipoise.

Suitable cold-setting bonding agents are polyvinyl acetate, a heat-cured acrylic copolymer, such as a copolymer of vinyl acetate and 2-ethyl hexyl acrylate or of styrene and butyl acrylate; with the preferred cold-setting bonding agent being a copolymer of ethylene and vinyl acetate. It has been found that when using a copolymer of ethylene and vinyl acetate problems involved with "gumming up" filter rod making equipment are reduced significantly thereby contributing to a lowered amount of equipment down time.

For the application of the bonding-agent emulsion, use may advantageously be made of a spinning cone rotating at high speed and producing a curtain of minute droplets of the emulsion, the spread tow being passed over the cone so that the droplets are distributed on the tow. To ensure effective uniform distribution of the emulsion, the cone is preferably rotated at a somewhat higher speed than is usual for conventional plasticizers, namely at a speed of the order of 4,000 r.p.m. Such a speed is particularly desirable, for achieving effective distribution and droplet size, if the viscosity of the emulsion is high. The emulsion may be thus applied at a rate of between 5% and 30%, preferably between 7% and 20%, by weight with reference to the fibre weight in the rod. Generally the dry weight of the bonding agent on the tow will be between 5% and 10% by weight only. A brush applicator or spraying means may be used as alternatives for applying the bonding agent.

For bringing the tow containing a uniform distribution of the bonding agent, to rod form, the tow may then be passed, in known manner, through a garniture in which it is formed into a continuous rod and may be wrapped. No application of heat, i.e. no separate heat-curing stage is necessary before, during or after the rod formation. The wrapper does not require a further application of adhesive for securing the fibre material to the wrapper, since the bonding agent acts also as adhesive or glue for the rod. The rod is then cut into sections.

Suitably, the filter rods or sections may be allowed to cure for up to 24 hours in normal storage without heating. The rod has a hardness, after curing, in the range of 86% to 95%, measured on the "Filtrona" (Trade Mark) Hardness and Resilience Tester, for a rod weight of 400-600 mg per 90 mm long rod.

Such a rod is eminently suitable for the production of firm cigarette filters.

The fibres of the tow need not consist solely of polyolefin material, but may contain of the order of 5 to 15% of other polymers or monomers which modify the characteristics of the fibre material with respect to its manufacture, for example the readiness with which it can be extruded or fibrillated. The presence of such additives does not detract from the effectiveness of the bonding agent.

An apparatus suitable for carrying out the method of this invention is shown in the accompanying schematic Figure. The tow 1 is fed to a tow processing unit 2 in which it is opened and then passed to a coating unit 3 in which the fibres of the tow are coated with the bonding agent. The coating unit preferably comprises a shear cone 4 which rotates at a speed high enough to produce a curtain of minute droplets which are distributed onto the tow, the emulsion being fed by means of a delivery tube 5. Alternatively the spray cone may be replaced by a brush means which applies the bonding agent to the tow.

The apparatus also includes a wrapper 6 fed from a spool 7 and the coated tow and the wrapper are fed together through a garniture 8 in which they are formed into a continuous rod. The formed rod is then passed through a cut off unit 9 in which the rod is cut into sections of predetermined length and delivered to a storage bin 10 where the rod lengths may be allowed to cure and harden, before being used, for example, as cigarette filters.

The following Examples illustrate the application of the invention:

EXAMPLE 1

A tow of crimped fibrillated polypropylene fibres of total denier 40,000 was opened and spread in a conventional filter-tow opening machine and was passed over an applicator shear cone at a speed of 100 m/min. The cone was rotated at 3750 r.p.m. to give a level of application of bonding agent of 15% of the fibre-weight. The bonding agent was a copolymer of ethylene and vinyl acetate in the form of an emulsion of viscosity 100 centipoise and solids content 55%.

This gave a level of dry weight of bonding agent on the tow web of approximately 8% referred to the weight of tow. In a conventional garniture, the web was brought to rod form and wrapped in a paper wrapper of 45 g/m$^2$ and was cut into sections. This paper, slightly heavier than usual, was used to obtain a satisfactory appearance of filter rod after cold-curing and to avoid warping in the paper. No lines of adhesive were required for anchoring the tow to the wrapper. After storage for 24 hours, without heating, the filter rods were found to have a hardness of 88% determined as indicated above.

In the following Examples, the procedure of Example 1 was followed except for the difference specified and the use of a higher speed of the shear cone, namely 4,000 r.p.m. approximately.

EXAMPLE 2

A copolymer of ethylene and vinyl acetate was again employed as bonding agent, but the viscosity of the emulsion was 50 centipoise and its solids content 44%. The level of addition of bonding agent on the tow was again 15%, the dry weight of the bonding agent in the finished rods being 6.6% referred to the weight of tow. The hardness of the filters produced was found to be 86% after 24 hours.

EXAMPLE 3

The bonding agent was an emulsion of a copolymer of vinyl acetate and 2-ethyl hexyl acrylate, the emulsion having a viscosity of 100 centipoise and a solids content of 47%. The bonding agent was applied to the tow at a level of addition of 15%, giving a dry weight of polymer on the tow of 7%. The filters had a hardness of 86% after 24 hours.

EXAMPLE 4

An emulsion of a finely divided, less than 0.5 microns, copolymer of stytrene and butyl acrylate having a viscosty of 52 centipoise and a solids content of 50% was applied to the tow in an amount sufficient to add 8% of dry polymer to the tow. The filters produced had a hardness of 86% after 24 hours.

EXAMPLE 5

A polyvinyl acetate emulsion having a viscosity of 140 centipoise and a solids content of 45% was applied to the tow in an amount sufficient to deposit 7% of dry polymer on the tow. The filters produced has a hardness of 88% after 24 hours

EXAMPLES 6 TO 9

A filter rod making machine was run with an ethylene/vinyl acetate copolymer emulsion adhesive, which had a solids content varying from 23 to 44 percent and a viscosity of 60 c.p.s.

The Examples were prepared on a filter rod making machine using a fibrillated polypropylene tow of total denier 40,000 comprising:

(i) an air banding jet for spreading the tow as it was drawn from a polypropylene bale;

(ii) a tow opening unit operable to apply tension to the spread tow and then to release the tension thus to cause "blooming" of the tow;

(iii) a second air banding jet;

(iv) an adhesive applicator unit comprised of a housing, a spinning cone applicator and adhesive supply means operable to supply adhesive to said cone;

(v) a pair of metering rollers each having a polished metal peripheral surface, one being of 8 inches diameter and the other, which is mounted above the first, having a diameter of 4 inches;

(vi) a garniture and endless garniture tape arranged to pull paper plugwrap and tow through the garniture; and, (vii) a cut-off unit operable to cut wrapped tow into individual rods.

In each of the Examples the spinning cone was run at 4000 revolutions per minute and the adhesive supply means was adjusted such that the application level of adhesive on the tow was 10 percent on a dry weight basis.

The average hardness of the resultant cut filter rods from each Example was then determined in accordance with the Coresta standard method, using a Filtrona Hardness Tester Mark 4E. In this test the diameter of a rod at a location in the length thereof after a weight of 300 grammes had been applied to the rod at said location for 15 seconds was measured and expressed as a percentage of the original undeformed diameter of the rod.

The hardness values determined were:

| Example No. | Solids Content (%) | Hardness (%) |
|---|---|---|
| 6 | 44 | 92 |
| 7 | 40 | 89.5 |
| 8 | 30 | 87.7 |
| 9 | 23 | 83.5 |

It was found that the relationship between the hardness measurement, according to the scale used, and the collapsing effect of the filter rods was significantly non-linear.

Furthermore, in each Example the tow ran in acceptable manner through the filter rod making machine with no "gumming-up" of the metering rollers or the garniture thereof. The rods of Example 6 had a fully adequate commercial hardness, but the rods of Example 9 had a hardness such as to be of very doubtful commercial acceptability.

It is claimed:

1. A method of making tobacco smoke filter rod from crimped fibrillated fibres of polypropylene, which comprises: spreading a tow of the fibres by passing the tow through a tow processing unit; applying to the spread (fibres) tow a cold-setting bonding agent comprising an emulsion of ethylene-vinyl acetate co-polymer, which emulsion has a viscosity in the range of 10 to 200 centipoise and a solids content in the range of 30 to 60 percent by weight and is applied to the tow in the form of a curtain of droplets, said emulsion being applied to the two in the form of a curtain of droplets by means of a spinning shear cone rotating at a speed of the order of 4,000 r.p.m.; and forming the fibres with the applied bonding agent into a filter rod without applying heat to set the bonding agent.

2. A method according to claim 1, wherein the emulsion has a solids content in the range of 45 to 55% by weight.

* * * * *

UNITED STATES PATENT AND TRADEMARK OFFICE

CERTIFICATE OF CORRECTION

PATENT NO. : 4,273,600

DATED : June 16, 1981

INVENTOR(S) : John A. Luke

It is certified that error appears in the above—identified patent and that said Letters Patent is hereby corrected as shown below:

At column 5, line 2, please correct the word "two" to read "tow"

Signed and Sealed this

*Third* Day of *November 1981*

[SEAL]

*Attest:*

GERALD J. MOSSINGHOFF

*Attesting Officer*

*Commissioner of Patents and Trademarks*